US005114819A

United States Patent [19]

Ong et al.

[11] Patent Number: 5,114,819

[45] Date of Patent: * May 19, 1992

[54] MAGNETIC ENCAPSULATED TONER COMPOSITIONS

[75] Inventors: Beng S. Ong, Mississauga; Guerino Sacripante, Cambridge; Grazyna Kmiecik-Lawrynowicz; T. Brian McAneney, both of Burlington, all of Canada

[73] Assignee: Xerox Corporation, Stamford, Conn.

[ * ] Notice: The portion of the term of this patent subsequent to Aug. 27, 2008 has been disclaimed.

[21] Appl. No.: 561,397

[22] Filed: Aug. 1, 1990

[51] Int. Cl.[5] ..... G03G 9/083; G03G 9/093

[52] U.S. Cl. ..... 430/106.6; 430/109; 430/138

[58] Field of Search ..... 430/106.6, 109, 138

[56] References Cited

U.S. PATENT DOCUMENTS

| | | | |
|---|---|---|---|
| 3,893,932 | 7/1975 | Azar et al. . | |
| 4,296,192 | 10/1981 | Gruber et al. | 430/109 |
| 4,520,091 | 5/1985 | Kakimi et al. | 430/110 |
| 4,581,312 | 4/1986 | Nakahara et al. | 430/102 |
| 4,642,281 | 2/1987 | Kakimi et al. | 430/138 |
| 4,761,358 | 8/1988 | Hosoi et al. | 430/109 |
| 4,780,390 | 10/1988 | Hosoi | 430/138 |
| 4,784,930 | 11/1988 | Hatakeyama | 430/138 |
| 4,803,144 | 2/1989 | Hosoi | 430/106.6 |
| 5,043,240 | 8/1991 | Ong et al. | 430/109 |

*Primary Examiner*—Roland Martin
*Attorney, Agent, or Firm*—E. O. Pazazzo

[57] ABSTRACT

An encapsulated toner composition comprised of a core comprised of a polymer binder, a nonvolatile organic liquid, and magnetite; and wherein the core is encapsulated in a polyether-urea polymer shell.

47 Claims, No Drawings

MAGNETIC ENCAPSULATED TONER COMPOSITIONS

BACKGROUND OF THE INVENTION

The present invention is generally directed to toner compositions, and more specifically to encapsulated toner compositions. In one embodiment, the present invention relates to encapsulated toner compositions comprised of a core comprised of a polymer binder, a nonvolatile organic liquid, and pigment, and a polymeric shell thereover prepared by interfacial polymerization in embodiments. The aforementioned polymeric shell, which in embodiments can comprise a polyether-urea material, possesses in many instances low permeability characteristics, and thus enables effective containment of the core components. The presence of a soft, flexible moiety such as a polyether segment in the shell polymer can improve the packing of the shell polymer in the shell structure. Proper packing of the shell polymers permits, for example, a high density shell structure, and lowers, suppresses, or in some instances may eliminate the shell's permeability thereof, especially to low molecular weight core components such as the core polymer binder and the nonvolatile organic liquid. A high degree of shell permeability can cause the undesirable loss of core components, particularly the aforementioned organic liquid, and thus drastically degrade the toner's properties. Another associated problem of shell permeability relates to the leaching of core binder to the toner's surface, and the associated problems of toner agglomeration or toner blocking, as well as image ghosting in imaging and printing processes, which problems are avoided or minimized with the toners of the present invention. A specific embodiment of the present invention relates to encapsulated toner compositions comprised of a core of a thermoplastic polymer, or plurality of polymers, binder, a nonvolatile organic liquid, and a magnetic pigment, and wherein the core is encapsulated within a polymer shell, such as polyether-urea shell, which toner has a number of advantages including, for example, the elimination or minimization of pen print-through associated with some prior art toners which have soft core polymer binders with low softening and glass transition temperatures. Other advantages of the toner compositions of the present invention in embodiments thereof include excellent toner fixing properties, excellent image visual quality and permanence, the absence or minimization of toner agglomeration, the absence or minimization of image ghosting, and retention of the core components. Another specific embodiment of the present invention relates to a pressure fixable encapsulated toner composition wherein the shell is comprised of the reaction product of a mixture of a polyether-based isocyanate or isocyanates and a polyisocyanate monomer or monomers selected, for example, from the group consisting of benzene diisocyanate, toluene diisocyanate, diphenylmethane diisocyanate, polymethylene diisocyanate, and the like, with a polyamine or polyamines. In another embodiment of the present invention, the toner compositions obtained can include thereon an electroconductive material, such as carbon black, graphite, and the like, thereby enabling compositions with a controlled and stable volume resistivity such as, for example, from about $1\times10^3$ to about $1\times10^8$ ohm-cm, and preferably from about $1\times10^4$ and $1\times10^6$ ohm-cm, which toners can be particularly useful for inductive single component development processes.

Examples of advantages associated with the toner compositions of the present invention in embodiments thereof are as indicated herein, and include the elimination and/or the minimization of image ghosting, excellent fixing characteristics, excellent image visual quality and very acceptable image permanence, acceptable surface release properties, in some instances, enabling their selection, for example, in imaging systems wherein a release fluid such as a silicone oil is avoided, substantially no toner agglomeration, acceptable powder flow characteristics, and minimal or no leaching or loss of the core components. Also, the toners of the present invention in embodiments thereof possess the advantages of the ability to provide a substantially higher image fix to plain paper, and in some instances, image fix levels equivalent to those of heat fused images; a shell with substantially improved mechanical properties; and moreover, the shell precursors selected possess in many instances low vapor pressures, thus reducing environment hazards. Further, with the toner compositions of the present invention in embodiments thereof, the shell does not rupture prematurely causing the core component comprised, for example, of a polymer binder and magnetite, or other pigment to become exposed, which upon contact with other toner particles or toner development subsystem component surfaces and the like forms undesirable agglomerates. The excellent surface release properties possessed by the toners of the present invention in embodiments thereof also provide for a complete or substantially complete transfer of toned images to a paper substrate during the development process. Furthermore, the toner compositions of the present invention can be obtained in high reaction yields in several embodiments thereof as the process of preparation thereof can involve a simple washing and sieving procedure to remove the coarse and fine particles in place of the conventional costly particle size classification procedure, thus dramatically lowering the manufacturing cost thereof. The toner compositions of the present invention can be selected for a variety of known reprographic imaging processes including electrophotographic and ionographic processes. In embodiments, the toner compositions of the present invention can be selected for pressure fixing processes for ionographic printing wherein dielectric receivers, such as silicon carbide, are utilized, reference U.S. Pat. No. 4,885,220, the disclosure of which is totally incorporated herein by reference. Specifically, the toner compositions of the present invention can be selected for image development in commercial Delphax printers such as the Delphax S9000, S6000, S4500, S3000, and Xerox Corporation printers such as the 4060 TM and 4075 TM, wherein, for example, transfixing is utilized, that is the transfer and fixing of the toned image from the dielectric receiver onto a paper substrate is accomplished simultaneously in one single step with pressure, with an image fix of at least 80 percent in an embodiment of the present invention. Another application of the toner compositions of the present invention is for two component development systems wherein, for example, the image toning and transfer is accomplished electrostatically, and the fixing of the transferred image is achieved by application of pressure, with or without the assistance of thermal energy.

The toner compositions of the present invention can, in one specific embodiment, be prepared by interfacial polymerization involving microcapsule shell-forming polycondensation, followed by in situ core polymer binder forming free radical polymerization of a core monomer or monomers in the presence of a free radical initiator. In a process embodiment of the present invention, the encapsulated toner can be prepared without using organic solvents as diluents or reaction media, thus eliminating, for example, explosion hazards associated therewith; and furthermore, these processes can be accomplished without expensive and hazardous solvent separation and recovery steps. Moreover, with the process of the present invention there are obtained in some instances improved toner throughput yield per unit volume of reactor size since, for example, the extraneous solvent component can be replaced by the nonvolatile organic liquid, the liquid core monomer(s) and shell precursor(s). The toners prepared in accordance with the process of the present invention are useful for permitting the development of images in reprographic imaging systems, inclusive of electrostatographic and ionographic imaging processes wherein pressure fixing is selected, and for other imaging and printing processes.

The toner compositions of the present invention can contain unique shell materials that permit the containment or substantial retention of the core components, thus eliminating or substantially suppressing core binder and organic liquid diffusion and leaching. As a consequence, the problems of toner agglomeration and image ghosting can be completely or substantially eliminated. Furthermore, the toner compositions of the present invention dramatically improve the efficiency of the image transfer process to substrates, such as paper, in many embodiments. Also, with the toner compositions of the present invention, particularly with respect to their selection for inductive single component development processes, the toner particles can contain on their surfaces a uniform and substantially permanently attached electroconductive material, thereby imparting certain stable electroconductive characteristics to the particles inclusive of situations wherein these particles are subjected to vigorous agitation. With some of the prior art encapsulated toners, the surface conductivity properties of the toner particles may be unstable when subjected to agitation, especially for example when electroconductive dry surface additives, such as carbon black, are selected. Further, with the aforementioned prior art toner compositions there are usually obtained images of low image quality with substantial background deposits, particularly after a number of imaging cycles, especially subsequent to vigorous mechanical agitation which can result in toner electroconductivity instability since, for example, the additives, such as carbon black, are not permanently retained on the surface of the toner. Additionally, several of the cold pressure fixing toner compositions of the prior art may have other disadvantages in some instances in that, for example, these compositions are obtained by processes which utilize organic solvents as diluents or as reaction media. The utilization of organic solvents renders the preparative process costly and potentially hazardous since most organic solvents are flammable and explosion-prone, and such processes also usually require expensive solvent separation and recovery steps. Moreover, the inclusion of solvents can also decrease the toner throughput yield per unit volume of reactor size. Furthermore, with many of the prior art processes toners of narrow size dispersity cannot be easily achieved as contrasted with the process of the present invention where narrow particle size distributions are generally obtained in embodiments thereof. In addition, many prior art processes provide deleterious effects on toner particle morphology and bulk density as a result of the removal of solvent and the subsequent collapse or shrinkage of toner particles during the toner work up and isolation processes resulting in a toner of very low bulk density. These disadvantages are substantially eliminated with the toners and processes of the present invention. More specifically, thus with the encapsulated toners of the present invention control of the toner physical properties of both the core and shell materials can be achieved. Specifically, with the encapsulated toners of the present invention in embodiments thereof undesirable leaching or loss of core components is avoided or minimized, and image ghosting is eliminated in many instances. Image ghosting is an undesirable phenomenon commonly encountered in ionographic printing when undesirable toner compositions are utilized. It refers, for example, to the repetitious printing of unwarranted images, and arises primarily from the contamination of the dielectric receiver by the unremovable toner materials. This problem can sometimes be partially eliminated by use of suitable surface release agents which aids in the removal of residual toner materials after image transfer. The toner compositions of the present invention eliminate or substantially eliminate the image ghosting problem by, for example, providing a polyether-urea shell which has a low permeability to the core components, thus effectively inhibiting their leakage to the toner surface, and preventing them from coming into contact with the dielectric receiver during the image transfix process. The shell materials of the present invention, with the aid of surface additives, also provides excellent surface release properties, thus enabling efficient removal of residual toner materials from the dielectric receiver surface. Furthermore, the excellent surface release properties afforded by the toner of the present invention can also dramatically enhance the image transfer efficiency of the transfix development processes.

In a patentability search report, the following prior art, all U.S. patents, were recited: U.S. Pat. No. 4,520,091 which discloses an encapsulated toner with a core of a colorant, a polymer, certain solvents, and an organic liquid with a boiling point in the range of 100° to 250° C., see for example the Abstract of the Disclosure; U.S. Pat. Nos. 4,642,281; 4,761,358 (see also column 5 wherein various shells are disclosed including polyureas); U.S. Pat. Nos. 4,780,390 and 4,784,930 (see also column 5 wherein shells composed of a complex layer of a polyurethane and a polyamide are disclosed, and at line 55, column 5, wherein there is recited the interfacial polymerization using a combination of a polyisocyanate and acid chloride, and polyamine), which disclose encapsulated toners with, for example, cores containing certain solvents, oily liquids, see for example column 3 of the '390 patent, in combination with a silicon; U.S. Pat. No. 4,581,312, see for example column 2, line 63, wherein a capsule toner comprising a core of a soft resin solution is recited; and U.S. Pat. Nos. 3,893,932; 4,296,192 and 4,803,144.

The following U.S. patents are mentioned: U.S. Pat. No. 3,967,962 which discloses a toner composition comprising a finely divided mixture comprising a colorant material and a polymeric material, which is a block or graft copolymer, including apparently copolymers of polyurethane and a polyether (column 6), reference for example the Abstract of the Disclosure, and also note the disclosure in columns 2 and 3, 6 and 7, particularly lines 13 and 35, however, it does not appear that encapsulated toners are disclosed in this patent; U.S. Pat. No. 4,565,764 which discloses a microcapsule toner with a colored core material coated successively with a first resin wall and a second resin wall, reference for example the Abstract of the Disclosure and also note columns 2 to 7, and particularly column 7, beginning at line 31, wherein the first wall may comprise polyvinyl alcohol resins known in the art including polyurethanes, polyureas, and the like; U.S. Pat. No. 4,626,490 contains a similar teaching as the '764 patent and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins, such as polyphenylene oxide or thioether resin, or mixtures thereof; and U.S. patents of background interest include U.S. Pat. Nos. 4,442,194; 4,465,755; 4,520,091; 4,590,142; 4,610,945; 4,642,281; 4,740,443 and 4,803,144.

With further specific reference to the prior art, there are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there is disclosed in the prior art encapsulated toner compositions usually containing pigments and dyes, reference for example the color photocapsule toners of U.S. Pat. Nos. 4,399,209; 4,482,624; 4,483,912 and 4,397,483.

Interfacial polymerization processes are also described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. Also, the shell-forming reaction disclosed in the aforementioned publication is initiated by heating the mixture to an elevated temperature at which point the isocyanate monomers are hydrolyzed at the interface to form amines, which then react with unhydrolyzed isocyanate monomers to enable the formation of a polyurea microcapsule wall. Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydrides as a soft component.

Furthermore, other representative prior art, includes U.S. Pat. Nos. 4,254,201; 4,465,755, and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, there are illustrated in U.S. Pat. No. 4,280,833 encapsulated materials prepared by interfacial polymerization in aqueous herbicidal compositions. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also of interest is the disclosure in column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art includes U.S. Pat. No. 4,520,091, the disclosure of which is totally incorporated herein by reference, which illustrates an encapsulated toner material wherein the shell can be formed by reacting a compound having an isocyanate with a polyamide, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamide to produce the shell, see column 4, line 34.

Illustrated in U.S. Pat. No. 4,758,506, the disclosure of which is totally incorporated herein by reference, are single component cold pressure fixable toner compositions, wherein the shell selected can be prepared by an interfacial polymerization process. Further in U.S. Pat. No. 5,043,240 (D/89069), the disclosure of which is totally incorporated herein by reference, there are illustrated encapsulated toners with a core comprised of a polymer binder, pigment or dye; and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there are disclosed in the aforementioned patent encapsulated toners comprised of a core containing a polymer binder, pigment or dye particles, and thereover a shell preferably obtained by interfacial polymerization, which shell has incorporated therein a polyether structural moiety. Another specific embodiment of the patent is directed to encapsulated toners comprised of a core of polymer binder, pigment dye or mixtures thereof, and a polymeric shell of a polyether-incorporated polymer, such as a poly(ether urea), a poly(ether amide), a poly(ether ester), a poly(ether urethane), mixtures thereof, and the like. The aforementioned toners can be prepared by an interfacial/free-radical polymerization process involving dispersing a mixture of core monomers, colorants, free radical initiator, and one or more water-immiscible shell precursors into microdroplets in an aqueous medium containing a stabilizer. One of the shell precursors in this organic phase is a polyether-containing monomers or prepolymers. The nature and concentration of the stabilizer employed in the generation of stabilized microdroplets depend mainly, for example, on the toner components, the viscosity of the mixture, as well as on the desired toner particle size. The shell-forming interfacial polymerization is effected by addition of a water soluble shell monomer into the reaction medium. The water soluble shell monomer in the aqueous phase reacts with the water-immiscible shell precursors in the organic phase at the microdroplet/water interface resulting in the formation of a microcapsule shell around the microdroplet. The formation of core binder from the core monomers within the newly formed microcapsule can be subsequently initiated by heating, thus completing the formation of an encapsulated toner. The toner compositions of the present invention contain, for example, a nonvolatile liquid; a readily flowable core composition is employed; the ready flowability of the core composition ensures its rapid diffusion out of the ruptured toners and efficient fixing onto the paper substrate during the image fixing step. As a result, excellent image fix, and excellent image definition and visual quality can be obtained. Furthermore, with proper choice of the nonvolatile organic liquid for the core composition, excellent image transfer as well as clean image development are readily accomplished in some embodiments.

There is a need for encapsulated toner compositions with many, and in some embodiments substantially, if not all, the advantages illustrated herein. More specifically, there is a need for encapsulated toners with core comprised of a polymer binder, a nonvolatile organic liquid, and a magnetite, and thereover an impermeable shell that can contain the core components within the shell effectively. Also, there is a need for encapsulated toners wherein images with excellent definition and resolution, and superior fix are obtained. Moreover, there is a need for encapsulated toners, wherein image ghosting, toner offsetting, and undesirable leaching of core components and the like are avoided or minimized. Additionally, there is a need for encapsulated toners with in some instances, excellent surface release characteristics enabling their selection in imaging systems without silicone oils and the costly apparatus associated therewith. Furthermore, there is a need for encapsulated toners, including colored toners, which exhibit no toner agglomeration thus providing a long toner shelf life exceeding, for example, one to two years, and wherein the core is encapsulated in a shell comprised of a polyether-urea material. Also, there is a need for encapsulated toners that have been surface treated with additives such as carbon blacks, graphite or the like to render them relatively conductive enough to a volume resistivity level of preferably from about $1\times10^3$ to $1\times10^8$ ohm-cm, and to enable their use in single component inductive development systems. Further, there is a need for encapsulated toners wherein surface additives such as metal salts or metal salts of fatty acids and the like are utilized to primarily assist in toner surface release properties. There is also a need for processes for the preparation of encapsulated toners with many of the advantages illustrated herein. Specifically, there is a need for interfacial polymerization processes for encapsulated toner compositions, wherein the core contains a polymer binder, a nonvolatile organic liquid, and a magnetite. Furthermore, there is a need for toners and improved processes thereof that will enable the preparation of pressure fixable encapsulated toner compositions whose properties such as shell strength, core binder molecular weight and the nature of core binder crosslinking can be desirably controlled. Moreover, there is a need for enhanced flexibility in the design and selection of materials for the toner shell and core, and the control of the toner physical properties, such as bulk density, particle size, and size dispersity.

SUMMARY OF THE INVENTION

It is a feature of the present invention to provide encapsulated toner compositions with many of the advantages illustrated herein.

It is also a feature of the present invention to provide encapsulated toner compositions which provide desirable toner properties such as nonagglomeration, nonghosting, high image fix, excellent image crease and rub resistance, low image gloss, and excellent image permanence characteristics.

In another feature of the present invention there are provided encapsulated toner compositions comprised of a core of a polymer binder, a nonvolatile organic liquid and a magnetic pigment, and thereover a polymeric shell prepared, for example, by interfacial polymerization which shell is comprised of a polyether-urea material which possesses low permeability characteristics, thus eliminating or suppressing the undesirable leaching or bleeding of core components.

Another feature of the present invention is the provision of encapsulated toners wherein image ghosting is eliminated in some embodiments, or minimized in other embodiments.

Further, another feature of the present invention is the provision of encapsulated toners wherein toner agglomeration is eliminated in some embodiments, or minimized in other embodiments.

Also, another feature of the present invention is the provision of encapsulated toners wherein core component leaching or loss is eliminated in some embodiments, or minimized in other embodiments.

Moreover, another feature of the present invention is the provision of encapsulated toners wherein toner offsetting is eliminated in some embodiments, or minimized in other embodiments.

Additionally, another feature of the present invention is the provision of encapsulated toners with extended shelf life.

It is yet another feature of the present invention to provide encapsulated toners wherein the contamination of the imaging member, such as a dielectric receiver, including electroreceptors, is eliminated or minimized.

Another feature of the present invention is the provision of encapsulated toners that can be selected for imaging processes, especially processes wherein pressure fixing is selected.

In another feature of the present invention there are provided simple and economical preparative processes for encapsulated cold pressure fixable toner compositions involving an interfacial shell-forming polymerization and an in situ free radical core polymer binder-forming polymerization whereby the shell formation, core binder formation, and the resulting toner material properties can be independently and desirably controlled.

Another feature of the present invention resides in the provision of simple and economical processes for pressure fixable toner compositions with durable, pressure-rupturable shells obtained by an interfacial/free radical polymerization process.

Moreover, in a further feature of the present invention there are provided processes for pressure fixable toner compositions wherein the core polymer binders thereof are obtained by in situ free radical polymerization of liquid addition-type monomers, which monomers also serve as a diluent and as a reaction medium for polymerization, thus eliminating the utilization of organic solvents as diluting vehicles or as reaction media in the process.

Moreover, in another feature of the present invention there are provided improved microcapsule shells which contain, for example, a polyether component in the shell material, thus enabling high quality encapsulated toner compositions.

Another feature of the present invention resides in the provision of encapsulated toners with thermoplastic core components, and wherein the bonding or adhesion of these thermoplastics to, for example, paper after fusing can be substantially permanent preventing, or minimizing transfer to another substrate with pressure. With the present invention in embodiments thereof the selection of a polymer coresolution of a thermoplastic resin renders the core soft, and flowable enabling, for example, excellent diffusion of the core components upon rupture of the toner shell.

These and other features in embodiments of the present invention can be accomplished by the provision of toners and, more specifically, encapsulated toners. In one embodiment of the present invention, there are provided encapsulated toners comprised of a core comprised of a polymer binder, a nonvolatile organic liquid such as an aliphatic hydrocarbon like Isopar®, and pigment, including magnetic pigments like magnetite, and wherein the core is encapsulated in an impermeable shell comprised of, in some embodiments, a polyether-urea material. Specifically, in one embodiment there is provided in accordance with the present invention encapsulated toners comprised of a core comprised of a polymer binder such as poly(isobutyl methacrylate), the Isopars, such as Isopar® H or Isopar® L, and a colorant; and wherein the core is encapsulated in a polymeric shell derived from the polycondensation of a mixture of a polyether isocyanate prepolymer and a polyisocyanate monomer with a polyamine. Another embodiment of the present invention is directed to encapsulated toners wherein the shell contains conductive components such as carbon black, graphite, or the like dispersed therein.

Embodiments of the present invention include an encapsulated toner composition comprised of a core comprised of a polymer binder, a nonvolatile organic liquid, and magnetite; and wherein the core is encapsulated in a polymer shell; an encapsulated toner composition comprised of a core comprised of a polymer binder, a nonvolatile organic liquid, and magnetite; and wherein the core is encapsulated in a polymeric shell derived from interfacial polycondensation of a mixture of polyether isocyanates and polyisocyanate monomers with polyamines; an encapsulated toner composition comprised of a core of a polymer binder, a nonvolatile liquid hydrocarbon, and magnetite; and wherein the core is encapsulated in a polymeric shell obtained by interfacial polycondensation of a mixture of polyether isocyanates and polyisocyanate monomers with polyamines; and a pressure fixable toner composition comprised of a core comprised of a polymer binder, a nonvolatile organic liquid, and a magnetite; and wherein the polymer resin is selected from the group consisting of acrylate polymers, methacrylate polymers, styrene polymers, and their copolymeric derivatives, which core is encapsulated within a polymeric shell comprised of the interfacial polycondensation reaction product of a polyisocyanate monomer and a polyether-based polyisocyanate with a polyamine, and wherein the polyisocyanate monomer is selected from the group consisting of toluene diisocyanate, PAPI 27, PAPI 135, PAPI 94, PAPI 901, Isonate 143L, Isonate 181, Isonate 125M, Isonate 191, and Isonate 240; the polyether-based polyisocyanate is selected from the group consisting of polyether Vibrathanes, and polyether isocyanate prepolymers; and the polyamine is selected from the group consisting of ethylenediamine, tetramethylenediamine, pentamethylenediamine, hexamethylenediamine, p-phenylenediamine, m-phenylenediamine, 2-methylpentamethylenediamine, 2-hydroxytrimethylenediamine, diethylenetriamine, triethylenetetraamine, tetraethylenepentaamine, 1,8-diaminooctane, xylylenediamine, bis(hexamethylene)triamine, tris(2-aminoethyl)amine, 4,4'-methylenebis(cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylenediamine.

The aforementioned toners of the present invention can be prepared by a chemical microencapsulation process involving first dispersing a mixture of core monomers, pigments, such as magnetic pigments, or a magnetic pigment, free radical initiator, one or more water immiscible shell precursors, and a nonvolatile organic liquid into microdroplets in an aqueous medium containing an emulsifying agent or stabilizer. The nature and concentration of the emulsifying agent or stabilizer employed depends on a number of factors such as, for example, the toner components, the viscosity of the mixture, the desired toner particle size, and the like. The microencapsulation can be achieved by a shell forming interfacial polymerization which is effected by the addition of a water soluble shell monomer into the reaction medium. The water soluble shell monomer from the aqueous phase reacts with the water immiscible shell precursors from the microdroplet phase at the microdroplet/water interface resulting in the formation of a microcapsule shell around the microdroplet. The formation of core polymer binder from the core monomers within the newly formed microcapsule is subsequently initiated by heating, thus completing the formation of an encapsulated toner of the present invention.

Illustrative examples of core monomers, which are subsequently polymerized to provide core polymer binders, and are present in an effective amount of from, for example, about 20 to about 90 percent by weight include acrylates, methacrylates, olefins, including styrene and its derivatives, and the like. Specific examples of core monomers, which are subsequently polymerized, include methyl acrylate and methacrylate, ethyl acrylate and methacrylate, propyl acrylate and methacrylate, butyl acrylate and methacrylate, pentyl acrylate and methacrylate, hexyl acrylate and methacrylate, heptyl acrylate and methacrylate, cyclohexyl acrylate and methacrylate, lauryl acrylate and methacrylate, stearyl acrylate and methacrylate, ethoxypropyl acrylate and methacrylate, methylbutyl acrylate, and methacrylate, benzyl acrylate and methacrylate, m-tolyl acrylate and methacrylate, styrene, methyl styrene, dodecyl styrene, hexylmethyl styrene, nonyl styrene, other known addition monomers, reference for example U.S. Pat. No. 4,298,672, the disclosure of which is totally incorporated herein by reference, and mixtures thereof. Other similar core monomers not specifically recited may also be selected.

The core compositions of the present invention contain a nonvolatile organic liquid for the primary purpose of rendering the core composition readily flowable. Illustrative examples of nonvolatile organic liquids, which are present in an effective amount of, for example, from about 1 to 20 weight percent, that can be selected include the known Isopars, ethylene glycol dimethyl ether, diethylene glycol dimethyl ether, triethylene glycol dimethyl ether, dialkyl terephthalate, chloronaphthalene, polyethylene glycol methyl ether, low viscosity polysiloxanes, anisole, dimethylanisole, 2,5-dimethoxy-2,5-dihydrofuran, Paraoils DD-8305-X, DA-8506, and Chloroflo 40 available from Dover Chemicals, Plastichlor 40–60 available from Shattuck Chemicals, Chlorowax 40, 45LV, 50LV, 100 available from Occidental Chemical Corporation, Toyoparax 120 available from Toyo Soka Company, other similar chloroparafins, alkylene glycol dialkyl ether, dialkylene glycol dialkylethers, trialkylene glycol dialkylethers, alkyl ethers, and the like.

Various known magnetic pigments, such as magnetites, present in the core in an effective amount of, for example, from about 20 to about 65 percent by weight, and preferably from about 40 to about 60 weight percent, that can be selected include Mobay magnetites MO8029 TM, MO8060 TM; Columbian Mapico Blacks, and surface treated magnetites; Pfizer magnetites CB4799 TM, CB5300 TM, CB5600 TM, MCX636 TM; Bayer magnetites Bayferrox 8600 TM, 8610 TM; Northern Pigments magnetites NP-604 TM, NP-608 TM; Magnox magnetites TMB-100 TM or TMB-104 TM; and other similar black pigments, including mixtures thereof.

As colored pigments there can be selected red, green, brown, blue, Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E.D. Toluidine Red and Bon Red C available from Dominion Color Corporation, Ltd., Toronto, Ontario, NOVAperm Yellow FGL, Hostaperm Pink E available from Hoechst, Cinquasia Magenta available from E.I. DuPont de Nemours & Company, and the like. Colored pigments that can be selected generally include cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the microencapsulated toner compositions in various suitable effective amounts. In one embodiment, the pigment particles are present in the toner composition in an amount of from about 2 percent by weight to about 65 percent by weight calculated on the weight of the dry toner.

The shell of the toner compositions of the present invention can be obtained by interfacial polymerization of a mixture of a polyether-based polyisocyanate and a polyisocyanate monomer with a polyamine. In embodiments, a plurality of polyether polyisocyanates, polyisocyanates and polyamines may be selected. Examples of polyether polyisocyanates, which are employed in an effective amount of, for example, from about 1 percent to 90 percent by weight of the total isocyanates used, and preferably in an amount of about 1 percent to about 30 percent by weight of the total isocyanates, include Uniroyal Chemical's diphenylmethane diisocyanate-based liquid polyether Vibrathanes such as B-635, B-843, and the like, and toluene diisocyanate-based liquid polyether Vibrathanes such as B-604, B-614, and the like, and Mobay Chemical Corporation's liquid polyether isocyanate prepolymers, E-21 or E-21A (product code number D-716), 743 (product code numbers D-301), 744 (product code number D-302), and the like. Illustrative examples of polyisocyanate monomer, which are utilized in an effective amount of from about 10 to about 99 weight percent, and preferably from about 70 to 98 weight percent, include those available commercially including, for example, benzene diisocyanate, toluene diisocyanate, diphenylmethane diisocyanate, 1,6-hexamethylene diisocyanate, bis(4-isocyanatocyclohexyl)-methane, MODUR CB-60, MONDUR CB-75, MONDUR MR, MONDUR MRS 10, PAPI 27, PAPI 135, Isonate 143L, Isonate 181, Isonate 125M, Isonate 191, and Isonate 240. Illustrative examples of suitable polyamines for the interfacial polycondensation shell formation, and which are employed in a slight molar excess of 1 to 15 percent relative to the total isocyanate quantity used, include, for example, ethylenediamine, tetramethylenediamine, pentamethylenediamine, hexamethylenediamine, 2-methylpentamethylenediamine, p-phenylenediamine, m-phenylenediamine, 2-hydroxytrimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, 1,4-bis(3-aminopropyl)-piperazine, and 2,5-dimethylpentamethylenediamine. Generally, the shell polymer comprises from about 5 to about 30 percent by weight of the total toner composition, and preferably comprises from about 8 percent by weight to about 20 percent by weight of the toner composition, and have a thickness generally, for example, of less than about 5 microns as indicated herein. During the aforementioned interfacial polycondensation to form the shell, the temperature is usually in embodiments maintained at from about 15° C. to about 55° C., and preferably from about 20° C. to about 30° C. Also, generally the reaction time can be, for example, from about 5 minutes to about 5 hours, and preferably from about 20 minutes to about 90 minutes. Other temperatures and times can be selected, and further polyisocyanates and polyamines not specifically illustrated may be selected. In one embodiment of the present invention, the shells are formed by interfacial polycondensation of a mixture of a polyether-based isocyanate and a polyisocyanate monomer with a diamine. The aforementioned polyisocyanate monomer that can be selected together with the polyether isocyanate prepolymer for the formation of shell material are those available commercially including, for example, benzene diisocyanate, toluene diisocyanate, diphenylmethane diisocyanate, 1,6-hexamethylene diisocyanate, bis(4-isocyanatocyclohexyl)methane, MODUR CB-60, MONDUR CB-75, MONDUR MR, MONDUR MRS 10, PAPI 27, PAPI 135, Isonate 143L, Isonate 181, Isonate 125M, Isonate 191, and Isonate 240. Other polymeric shells may also be selected in embodiments of the present invention.

Another embodiment of the present invention relates to encapsulated toners with the aforementioned shell and wherein the toner includes thereon an electroconductive material obtained, for example, from a water dispersion of said electroconductive material in a polymeric binder. The aforementioned polyether-based isocyanate can be selected from the group consisting of Uniroyal Chemical's polyether Vibrathanes B-604, B-614, B-635, B-843, and Mobay Chemical Corporation's polyether isocyanate prepolymers E-21 or E-21A, XP-743, XP-744, and the like. The polyamine is selected, for example, from the group consisting of ethylenediamine, tetramethylenediamine, pentamethylenediamine, hexamethylenediamine, 2-methylpentamethylenediamine, p-phenylenediamine, m-phenylenediamine, 2-hydroxytrimethylenediamine, diethylenetriamine, triethylenetetraamine, tetraethylenepentaamine, 1,8-diaminooctane, xylylene diamine, bis(hexamethylene) triamine, tris(2-aminoethyl) amine, 4,4'-methylene bis(cyclohexylamine), bis(3-aminopropyl)ethylene diamine, 1,3-bis(aminomethyl) cyclohexane, 1,5-diamino-2-methylpentane; and piperazine, 2-methylpiperazine, 2,5-dimethylpiperazine, 1,4-bis(3-aminopropyl) piperazine, and the like.

Other isocyanates may be selected for the reaction with the polyamine to enable formation of the shell by interfacial polymerization, reference for example U.S. Pat. No. 4,612,272 and U.K. Patents, 2,107,670 and 2,135,469, the disclosures of which are totally incorporated herein by reference.

As a preferred shell material, there is selected the interfacial polycondensation product of a mixture of polyether isocyanate prepolymer E-21 or E-21A and Isonate 143L with 1,4-bis(3-aminopropyl)piperazine or 2-methylpentamethylenediamine in the molar ratios of polyisocyanate to polyamine of from about 1:0.95 to 1:1.20, and preferably from about 1:1.03 to 1:1.10; the mole ratio of prepolymer E-21 or E-21A to Isonate 143L that can be employed is from about 0.005:0.995 to 0.50:0.50, and preferably from about 0.02:0.98 to 0.20:0.80.

Interfacial processes that can be selected for the shell formation of the toners of the present invention are as illustrated herein and, for example, in U.S. Pat. Nos. 4,000,087 and 4,307,169, the disclosures of which are totally incorporated herein by reference.

Surface additives can be selected for the toners of the present invention including, for example, metal salts, such as metal oxides, like tin oxide, metal salts of fatty acids, colloidal silicas, mixtures thereof and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. In embodiments, specific additives include zinc stearate and Aerosil R972.

The aforementioned toner compositions of the present invention can be prepared by a number of different processes as indicated herein including the interfacial/-free radical polymerization process comprising mixing or blending of a core monomer or monomers, up to for example 20, a nonvolatile organic liquid such as Isopar, a mixture of reactive shell components, free radical initiator, and pigment, such as magnetic pigment; dispersing this mixture of organic materials and pigment by high shear blending into stabilized microdroplets of specific droplet size and size distribution in an aqueous medium with the aid of suitable stabilizer or emulsifying agents wherein the average volume microdroplet diameter generally can be desirably adjusted to be from about 5 microns to about 30 microns with the average volume droplet size dispersity being generally less than about 1.4 as inferred from the Coulter Counter measurements of the microcapsule particles after encapsulation; subsequently subjecting the aforementioned dispersion to a shell forming interfacial polycondensation by adding a water miscible polyamine; and thereafter, initiating the heat-induced free radical polymerization for the formation of core binder within the newly formed microcapsules. The shell forming interfacial polycondensation is generally executed at ambient temperature, but elevated temperatures may also be employed depending on the nature and functionality of the shell components used. For the core binder-forming free radical polymerization, it is generally accomplished at temperatures from ambient temperature to about 100° C., and preferably from ambient temperature to about 85° C. In addition, more than one known initiator may be utilized to, for example, enhance the polymerization conversion, and to generate the desired molecular weight and molecular weight distribution.

Illustrative examples of free-radical initiators selected include azo compounds such as 2-2' azodimethylvaleronitrile, 2-2' azoisobutyronitrile, azobiscyclohexanenitrile, 2-methylbutyronitrile, or any mixtures thereof, and other similar known compounds with the quantity of initiator(s) being, for example, from about 0.5 percent to about 10 percent by weight of that of core monomer(s). Stabilizers selected include water soluble polymeric surfactants such as poly(vinyl alcohols), partially hydrolyzed poly(vinyl alcohols), hydroxypropyl cellulose, methyl cellulose with a stabilizer to water ratio of from about 0.05 to about 0.75 for example.

The encapsulated toner compositions of the present invention in embodiments thereof are mechanically and thermally stable and possess acceptable shelf-life stability. For example, the encapsulated toners do not suffer from shell premature rupture, and are nonblocking and nonagglomerating at temperatures of up to 60° C. The shell materials of the present invention in embodiments thereof are robust, and display a low degree of shell permeability to the core components, and in particular to the core polymer binder and the nonvolatile organic liquid. No, or minimal, leaching or bleeding of core components occurs at storage for an extended period of time of over one to two years in embodiments of the present invention. The toner compositions of the present invention can also display excellent powder flow and surface release properties, which can enable, for example, high image transfer efficiency and prevent image ghosting and offset during image development.

Also, the toner compositions can be rendered relatively conductive with, for example, a volume resistivity value of from about $1\times10^3$ ohm-cm to about $1\times10^8$ ohm-cm by adding to the toner surface thereof components such as carbon blacks, graphite, conductive organometallic compounds, and the like. The aforementioned toner compositions of the present invention are particularly useful for the inductive single component development of electrostatic images.

In accordance with the present invention, there is provided a method for developing electrostatic images which comprises forming latent electrostatic images on the surface of a hard dielectric image cylinder by depositing ions thereon from a corona source; toning the images with the single component magnetic toner composition illustrated herein; followed by simultaneous transferring and fixing by pressure onto paper in embodiments a toner transfer efficiency greater than 95 percent, and in many instances over 99 percent. The transfix pressure utilized for image fixing generally is from less than about 1,000 psi to about 4,000 psi, and in an embodiment the transfix pressure can be 2,000 psi or less, primarily to eliminate or alleviate the paper calendering and high image gloss problems. Examples of pressure fixing processes and systems that can be selected include those commercially available from Delphax, Hitachi, Cybernet, and others.

Further, the present invention is directed to methods for the development of images by, for example, forming by ion deposition on an electroreceptor, such as a polymer impregnated anodized aluminum oxide, a latent image, developing this image with the pressure fixable encapsulated toner compositions of the present invention, and subsequently simultaneously transferring and fixing the image onto a suitable substrate such as paper.

For two component developers, carrier particles including steel, iron, ferrites, copper zinc ferrites, and the like, with or without coatings, can be admixed with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to be illustrative only and are not intended to limit the scope of the present invention.

EXAMPLE I

An 18.9 micron (volume average diameter) encapsulated toner comprised of a polyether-urea shell, and a core of poly(lauryl methacrylate), Isopar® H, and Magnox's TMB-100 magnetite was prepared as follows:

A mixture of lauryl methacrylate (113 grams), 2,2'-azo-bis(2,4-dimethyl-valeronitrile) (3.3 grams), 2,2'-azo-bis-(isobutyronitrile) (3.3 grams), Isonate 143L (42.2 grams), and Bayer's polyether isocyanate prepolymer E-21 (5.7 grams) was homogenized in a 2-liter Nalgene container with a Brinkmann polytron at 4,000 RPM for 30 seconds. To this mixture were then added Magnox TMB-100 magnetite (300 grams) and Isopar H (20 milliliters), and the corresponding slurry was homogenized at 8,000 RPM for three minutes. To the resulting mixture was added 1 liter, 0.10 percent (by weight), of an aqueous poly(vinyl alcohol) (88 percent hydrolyzed; MW 96,000) solution, and thereafter, the mixture was homogenized again at 9,000 RPM for 2 minutes. The resulting dispersion was transferred to a 2-liter reaction kettle immersed in an oil bath, and equipped with a mechanical stirrer. To the kettle contents was then added a solution of 37 milliliters, of 1,4-bis(3-aminopropyl)piperazine in 80 milliliters of water, and the resulting mixture was allowed to react for one hour. Thereafter, the kettle was heated to 85° C. over a period of one hour, and polymerization was continued at this temperature for 6 hours before cooling down to room temperature. The resulting mixture was then transferred to a 4-liter beaker, and diluted with water to a volume of about four liters with constant stirring. The encapsulated toner particles were allowed to settle to the bottom of the beaker by gravity, and the aqeuous supernatant was carefully decanted. The washing was repeated in this manner three times until the washing was clear. The washed toner was transferred to a 2-liter beaker and diluted with water to a total volume of 1.8 liter. Aquadag graphite E (23.5 grams, from Acheson Colloids), and water (100 milliliters) were then added, and the mixture was spray dried in a Yamato Spray Dryer at an air inlet temperature of 160° C., and an air outlet temperature of 80° C. The air flow was maintained at 0.75 $m^3$/minute, while the atomizing air pressure was retained at 1.0 kilogram/$cm^2$. The collected dry encapsulated toner (369 grams) was screened through a 63 micron sieve; the toner's volume average particle diameter, as measured on a 256 channel Coulter Counter, was 18.9 microns with a volume average particle size dispersity of 1.33.

Two hundred and forty (240) grams of the above encapsulated toner A was dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM to provide an encapsulated toner with a volume resistivity of $1\times10^6$ ohm-cm. as determined in a test cell device with a sample of the toner therein and wherein a current is passed through the toner.

The pressure fixing ionographic printer selected for the testing of the prepared toner composition was the Delphas S-6000 TM printer. The developed images were transfixed at a pressure of 2,000 psi. Print quality was evaluated from a checkerboard print pattern. The image optical density was measured using a standard integrating densitometer. Image fix was measured by the standardized tape pull method wherein a tape was pressed with a uniform reproducible standard pressure against an image and then removed. The image fix level is expressed as a percentage of the retained image optical density after the tape test relative to the original image optical density. Image ghosting was evaluated qualitatively for over 2,000 prints. Toner shell integrity was judged qualitatively by observing any crushed or agglomerated toner on the hopper screen through which toner was fed to the printer machine magnetic roller. If crushed toner was found to adhere to and clog some of the screen openings after 2,000 copies, it was judged to have a premature toner rupture problem.

For the encapsulated toner of this Example, the image fix level was 87 percent with no image ghosting, and no toner agglomeration in the development housing for 2,000 prints. Furthermore, this toner did not display aggregation or agglomeration on standing, and no toner blocking was observed at 55° C. for 48 hours.

EXAMPLE II

A 18.1 micron encapsulated toner was prepared in accordance with the procedure of Example I except that the volume of Isopar® H was increased from 20 milliliters to 40 milliliters.

The collected encapsulated dry toner (377 grams) was then screened through a 63 micron sieve; the toner's volume average particle diameter, as measured on a 256 channel Coulter Counter, was 18.1 microns with a volume average particle size dispersity of 1.31.

Two hundred and forty (240) grams of the encapsulated dry toner was dry blended using a Greey blender, first with 0.96 gram of carbon black (Black Pearls 2000) for 2 minutes with the blending impeller operating at 3,500 RPM, and then with 3.6 grams of zinc stearate for another 10 minutes at the impeller speed of 3,000 RPM to provide a volume resistivity of $8\times10^5$ ohm-cm. This toner was free flowing, and was stable at 55° C. for at least 48 hours.

Machine printer testing of this toner was accomplished in accordance with the procedure of Example I. For this toner, the image fix level was 93 percent, and no image ghosting was observed after 2,000 prints. Furthermore, no toner agglomeration was detected in the development housing of the printer.

EXAMPLE III

A 18.7 micron encapsulated toner with a polyether-urea shell and a core of poly(lauryl methacrylate), Isopar® L, and Columbia Chemical's Mapico Black magnetite was prepared as follows:

A mixture of lauryl methacrylate (132 grams), 2,2'-azo-bis-(2,4-dimethyl-valeronitrile) (2.6 grams), 2,2'-azobis-(isobutyronitrile) (2.6 grams), Isonate-143L (42.2 grams), and Bayer's polyether isocyanate prepolymer XP-744 (5.7 grams) was homogenized in a 2-liter Nalgene container with a Brinkmann polytron at 4,000 RPM for 30 seconds. To this mixture were added Mapico Black magnetite (280 grams) and Isopar® L (40 milliliters), and the corresponding slurry was homogenized at 8,000 RPM for three minutes. To the mixture was then added 1 liter, 0.10 percent (by weight), of an aqueous poly(vinyl alcohol) (88 percent hydrolyzed; MW 96,000) solution, and thereafter, the mixture was homogenized at 9,000 RPM for 2 minutes. The resulting dispersion was transferred to a 2-liter reaction kettle immersed in an oil bath and equipped with a mechanical stirrer. To the kettle contents was then added a solution of 37 milliliters of 1,4-bis-(3-aminopropyl)piperazine in 80 milliliters of water, and the resulting mixture was allowed to react for one hour. Thereafter, the kettle was heated to 85° C. over a period of 1 hour, and was maintained at this temperature for another 5 hours before cooling to room temperature. The resulting reaction mixture was transferred to a 4-liter beaker, and washed by diluting with water to a volume of four liters with constant stirring. The toner particles were allowed to settle to the bottom of the beaker by gravity, and the aqueous supernatant was decanted. The aforementioned washing was repeated in this manner three times until the washing was clear. The wet encapsulated toner was transferred to a 2-liter beaker and diluted with water to a total volume of 1.8 liters. Aquadag graphite E (23.5 grams, from Acheson Colloids) and water (100 milliliters) were added to the beaker, and the resulting mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 kilogram/$cm^2$. The collected dry toner (373 grams) was screened through a 63 micron sieve; the toner's volume average particle diameter was measured to be 18.7 microns with a volume average particle size dispersity of 1.34.

Two hundred and forty (240) grams of the above encapsulated toner was dry-blended using a Greey blender, first with 0.96 gram of carbon black (Black Pearls 2000) for 2 minutes with the blending impeller operating at 3,500 RPM, and then with 3.6 grams of zinc stearate for another 10 minutes at the impeller speed of 3,000 RPM to provide a toner resistivity of $9\times10^5$ ohm-cm. This toner displayed no agglomeration on standing, and provided an image fix level of 91 percent without image ghosting for 2,000 prints.

EXAMPLE IV

A 19.2 micron encapsulated toner comprising a polyether-urea shell, and a core of poly(lauryl methacrylate), Isopar® K, and Northern Pigments' NP-608 magnetite was prepared as follows.

A toner was prepared in accordance with the procedure of Example II with the exception that Isopa®r K (40 milliliters) and Northern Pigments NP-608 (280 grams) were utilized in place of Isopar® H and TMB-100 magnetite, respectively. Three hundred and sixty (360) grams of the above prepared encapsulated dry toner with a volume average particle diameter of 19.2 microns and a volume average particle size dispersity of 1.36 were obtained. This toner did not exhibit toner agglomeration, and was stable at 55° C. for at least 48 hours. Also, this encapsulated toner provided an image fix level of 92 percent in the Delphax S-6000 TM testing printing machine with no observable image ghosting for 2,000 prints.

EXAMPLE V

A 17.1 micron encapsulated toner comprising a polyether-urea shell and a core of lauryl methacrylate-stearyl methacrylate copolymer resin, Paraoil DD-8305-X (Dover Chemicals), and TMB-100 magnetite was prepared as follows:

The toner was prepared in accordance with the procedure of Example II with the exception that a mixture of lauryl methacrylate (56.5 grams) and stearyl methacrylate (56.5 grams) was employed in place of lauryl methacrylate, and that Paraoil DD-8305-X was used instead of Isopar ® H. In addition, 0.12 percent instead of 0.10 percent of the aqueous poly(vinyl alcohol) solution was utilized. Three hundred and eighty-five (385) grams of dry encapsulated toner with a volume average particle diameter of 17.1 microns and a volume average particle size dispersity of 1.34 were obtained. The toner exhibited no signs of agglomeration at a temperature of 55° C. for at least 48 hours. Also, this toner was machine tested in accordance with the procedure of Example I, and substantially similar results were obtained.

EXAMPLE VI

A 16.8 micron encapsulated toner with a polyether-urea shell and a core of lauryl methacrylate-stearyl methacrylate copolymer resin, Chlorowax 45LV (Occidental Chemical Corporation) and NP-608 magnetite was prepared as follows.

The toner was prepared in accordance with the procedure of Example II with the exception that a mixture of lauryl methacrylate (56.5 grams) and stearyl methacrylate (56.5 grams) was employed in place of lauryl methacrylate, and that Chlorowax (40 milliliters) in dichloromethane (10 milliliters) and NP-608 magnetite (280 grams) were utilized instead of Isopar ® H and TMB-100 magnetite, respectively. In addition, 0.12 percent instead of 0.10 percent of the aqueous poly(vinyl alcohol) solution was utilized. Three hundred and sixty-eight (368) grams of an encapsulated dry toner with a volume average particle diameter of 16.8 microns and a volume average particle size dispersity of 1.36 were obtained. The toner exhibited no signs of agglomeration, and when machine tested in accordance with the procedure of Example I, substantially similar results were obtained.

EXAMPLE VII

A 15.6 micron encapsulated toner with a polyether-urea shell and a core of poly(lauryl methacrylate) resin, Isopar ® L and Bayferrox 8610 magnetite was prepared as follows:

The toner was prepared in accordance with the procedure of Example II with the exception that a mixture of polyether isocyanate prepolymer E-21 (2.5 grams) and polyether Vibrathane B-604 (2.5 grams) was utilized in place of polyether isocyanate prepolymer E-21, and that TMB-100 magnetite and Isopar ® H were, respectively, replaced with Bayferrox 8610 (300 grams) and Isopar ® L (40 milliliters). In addition, 0.15 percent instead of 0.10 percent of the aqueous poly(vinyl alcohol) solution was utilized for the preparation. Three hundred and sixty (360) grams of encapsulated dry toner with a volume average particle diameter of 15.6 microns and a volume average particle size dispersity of 1.34 were obtained. This toner exhibited no signs of agglomeration, and when evaluated in accordance with the procedure of Example I, substantially similar results were obtained.

EXAMPLE VIII

A 18.6 micron encapsulated toner with a polyether-urea shell and a core of poly(lauryl methacrylate), Paraoil DD-8305-X (Dover Chemicals) and Mapico Black magnetite was prepared as follows:

The toner was prepared in accordance with the procedure of Example II with the exception that Isopar ® H, TMB-100 magnetite and polyether isocyanate prepolymer E-21 were, respectively, replaced with Paraoil, Mapico Black magnetite and Bayer's polyether isocyanate prepolymer XP-744 (5.7 grams). The collected dry toner (370 grams) was screened through a 63 micron sieve; the toner's volume average particle diameter was measured to be 18.6 microns with a volume average particle size dispersity of 1.32. The toner was evaluated in accordance with the procedure of Example I and substantially similar results were obtained.

EXAMPLE IX

A 15.7 micron encapsulated toner with a polyether-urea shell and a core of lauryl methacrylate-stearyl methacrylate copolymer, Plastichloro (Shattuk Chemicals) and Mapico Black magnetite was prepared as follows:

The toner was prepared in accordance with the procedure of Example II with the exception that a mixture of lauryl methacrylate (100.0 grams) and stearyl methacrylate (13.0 grams) was utilized instead of lauryl methacrylate, and that Isopar ® H and TMB-100 magnetite were replaced with Plastichloro and Mapico Black magnetite, respectively. In addition, 0.15 percent instead of 0.10 percent of the aqueous poly(vinyl alcohol) solution was utilized for the preparation. Three hundred and seventy-two (372) grams of encapsulated dry toner with a volume average particle diameter of 15.7 microns and a volume average particle size dispersity of 1.33 were obtained. This toner exhibited no signs of agglomeration, and when evaluated in accordance with the procedure of Example I, substantially similar results were obtained.

EXAMPLE X

A 15.2 micron encapsulated toner with a polyether-urea shell and a core of lauryl methacrylate-stearyl methacrylate, Chloroflo 40 (Dover Chemicals), and Mapico Black magnetite was prepared as follows:

The toner was prepared in accordance with the procedure of Example II with the exception that a mixture of lauryl methacrylate (100.0 grams) and stearyl methacrylate (13.0 grams) was utilized in place of lauryl methacrylate, and that Isopar ® H, TMB-100 magnetite and polyether isocyanate prepolymer E-21 were replaced, respectively, with Chloroflo 40, Mapico Black magnetite and a mixture of polyether isocyanate prepolymer E-21 (2.5 grams) and polyether Vibrathane B-604 (2.5 grams). In addition, 0.15 percent instead of 0.10 percent of the aqueous poly(vinyl alcohol) solution was used for the preparation. Three hundred and sixty-six (366) grams of encapsulated dry toner with a volume average particle diameter of 15.2 microns and a volume average particle size dispersity of 1.32 were obtained. This toner exhibited no signs of agglomeration, and when evaluated in accordance with the procedure of Example I, substantially similar results were obtained.

Other modifications of the present invention may occur to those skilled in the art subsequent to a review of the present application, and these modifications, including equivalents thereof, are intended to be included within the scope of the present invention.

What is claimed is:

1. An encapsulated toner composition comprised of a core comprised of a polymer binder, a nonvolatile organic liquid, and magnetite; and wherein the core is encapsulated in a polyether-urea polymer shell.

2. An encapsulated toner composition comprised of a core comprised of a polymer binder, a nonvolatile organic liquid. and magnetite; and wherein the core is encapsulated in a polymeric shell derived from interfacial polycondensation of a mixture of polyether isocyanates and polyisocyanate with polyamines.

3. An encapsulated toner composition comprised of a core of a polymer binder, a nonvolatile liquid hydrocarbon, and magnetite; and wherein the core is encapsulated in a polymeric shell obtained by interfacial polycondensation of a mixture of polyether isocyanates and polyisocyanate with polyamines.

4. A toner in accordance with claim 1 wherein the core polymer binder is an acrylate polymer, a methacrylate polymer, or a styrene polymer.

5. A toner in accordance with claim 2 wherein the core polymer binder is an acrylate polymer, a methacrylate polymer, or a styrene polymer.

6. A toner in accordance with claim 3 wherein the core polymer binder is an acrylate polymer, a methacrylate polymer, or a styrene polymer.

7. An encapsulated toner composition in accordance with claim 3 wherein the nonvolatile liquid hydrocarbon is an Isopar®.

8. A toner in accordance with claim 1 wherein the core polymer binder is derived from polymerization of an addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, and nonyl styrene.

9. A toner in accordance with claim 2 wherein the core polymer binder is derived from polymerization of an addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, and nonyl styrene.

10. A toner in accordance with claim 3 wherein the core polymer binder is derived from polymerization of an addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, and nonyl styrene.

11. A toner in accordance with claim 1 wherein the magnetite is Mapico Black, or surface treated magnetites.

12. A toner in accordance with claim 7 wherein the Isopar® is Isopar® E,F,G,H,K,L,M or mixtures thereof.

13. A toner in accordance with claim 1 wherein the polymeric shell represents from about 5 percent to about 30 percent by weight of the toner, the core polymer binder represents from about 20 to about 90 percent by weight of the toner, the nonvolatile organic liquid represents from about 1 percent to about 20 percent by weight of the toner, and the magnetite represents from about 30 percent to about 65 percent by weight of the toner.

14. A toner in accordance with claim 1 containing surface additives.

15. A toner in accordance with claim 14 wherein the surface additives are metal salts, metal salts of fatty acids, or colloidal silicas.

16. A toner in accordance with claim 14 wherein the colloidal silica is an Aerosil, and the metal salt of the fatty acid is zinc stearate.

17. A toner in accordance with claim 14 wherein the additives are present in an amount of from about 0.1 to about 5 weight percent.

18. A toner in accordance with claim 1 wherein the shell is prepared by interfacial polymerization.

19. A toner in accordance with claim 1 wherein the polymeric shell is comprised of the interfacial polycondensation product of at least one polyisocyanate monomer, and at least one polyether-based polyisocyanate with a polyamine.

20. A toner in accordance with claim 19 wherein the polyether-based polyisocyanate is selected for the interfacial polycondensation reaction in an amount of from about 0.5 percent to about 90 percent by weight of the total isocyanates selected.

21. A toner in accordance with claim 19 wherein the polyether-based polyisocyanate is employed in the interfacial polycondensation reaction in an amount of from about 1 percent to about 30 percent by weight of the total isocyanates selected.

22. A toner in accordance with claim 19 wherein the polyether-based polyisocyanate is selected from the group consisting of polyether Vibrathanes, and polyether isocyanate prepolymers.

23. A toner in accordance with claim 19 wherein a plurality of polyisocyanate monomers are selected.

24. A toner in accordance with claim 19 wherein one of the polyisocyanate monomers is selected from the group consisting of benzene diisocyanate, toluene diisocyanate, diphenylmethane diisocyanate, 1,6-hexamethylene diisocyanate, bis(4-isocyanatocyclohexyl)-methane, Papi 27, Papi 135, Papi 94, Papi 901, Isonate 143L, Isonate 181, Isonate 125M, Isonate 191, and Isonate 240; and the polyamine component is selected from the group consisting of ethylenediamine, tetramethylenediamine, pentamethylenediamine, hexamethylenediamine, p-phenylenediamine, m-phenylenediamine, 2-methylpentamethylenediamine, 2-hydroxytrimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis-(aminomethyl)cyclohexane, 1,5-diamino-2-methylpentane, piperazine, 2-methylpiperazine, 2,5-dimethylpiperazine, and 1,4-bis(3-aminopropyl)piperazine.

25. A toner in accordance with claim 1 wherein the polymeric sheel contains conductive components.

26. A toner in accordance with claim 25 wherein the conductive components are selected from the group consisting of carbon black, graphite, and mixtures thereof.

27. A pressure fixable toner composition comprised of a core comprised of a polymer binder, a nonvolatile organic liquid, and a magnetite; and wherein the polymer resin is selected from the group consisting of acrylate polymers, methacrylate polymers, styrene polymers, and their copolymeric derivatives, which core is encapsulated within a polymeric shell comprised of the interfacial polycondensation reaction product of a polyisocyanate monomer and a polyether-based polyisocyanate with a polyamine, and wherein the polyisocyanate monomer is selected from the group consisting of toluene diisocyanate, PAPI 27, PAPI 135, PAPI 94, PAPI 901, Isonate 143L, Isonate 181, Isonate 125M, Isonate 191, and Isonate 240; the polyether-based polyisocyanate is selected from the group consisting of polyether Vibrathanes, and polyether isocyanate prepolymers; and the polyamine is selected from the group consisting of ethylenediamine, tetramethylenediamine, pentamethylenediamine, hexamethylenediamine, p-phenylenediamine, m-phenylenediamine, 2-methylpentamethylenediamine, 2-hydroxytrimethylenediamine, diethylenetriamine, triethylenetetraamine, tetraethylenepentaamine, 1,8-diaminooctane, xylylenediamine, bis(hexamethylene)triamine, tris(2-aminoethyl)amine, 4,4'-methylenebis(cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine, and 2,5-dimethylpentamethylenediamine.

28. A toner in accordance with claim 27 wherein the monomer for the core polymer binder is selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, methyl styrene, dodecyl styrene, methylhexyl styrene, and nonyl styrene.

29. A method of imaging which comprises forming by ion deposition on an electroreceptor a latent image, subsequently developing this image with the toner composition of claim 1, and thereafter transferring and fixing the image to a suitable substrate.

30. A method of imaging which comprises forming by ion deposition on an electroreceptor a latent image, subsequently developing this image with the toner composition of claim 2, and thereafter simultaneously transferring and fixing the image to a suitable substrate.

31. A method of imaging which comprises forming by ion deposition on an electroreceptor a latent image, subsequently developing this image with the toner composition of claim 3, and thereafter simultaneously transferring and fixing the image to a suitable substrate.

32. A method of imaging in accordance with claim 29 wherein there results images with excellent image fixing characteristics.

33. A method of imaging in accordance with claim 30 wherein there results images with excellent image fixing characteristics.

34. A method of imaging in accordance with claim 31 wherein there results images with excellent image fixing characteristics.

35. A method of imaging in accordance with claim 29 wherein fixing is accomplished at pressures of from about 500 psi to about 6,000 psi.

36. A toner in accordance with claim 1 wherein the non-volatile organic liquid is selected from the group consisting of Isopars ®, ethylene glycol dimethyl ether, diethylene glycol dimethyl ether, triethylene glycol dimethyl ether, dialkyl terephthalate, chloronaphthalene, polyethylene glycol methyl ether, low viscosity polysiloxanes, anisole, dimethylanisole, 2,5-dimethoxy-2,5-dihydrofuran, Paraoils DD-8305-X, DA-8506, and Chloroflo 40, Plastichlor 40–60, Chlorowax 40, and Toyoparax 120.

37. A toner in accordance with claim 2 wherein the non-volatile organic liquid is selected from the group consisting of Isopars ®, ethylene glycol dimethyl ether, diethylene glycol dimethyl ether, triethylene glycol dimethyl ether, dialkyl terephthalate, chloronaphthalene, polyethylene glycol methyl ether, low viscosity polysiloxanes, anisole, dimethylanisole, 2,5-dimethoxy-2,5-dihydrofuran, Paraoils DD-8305-X, DA-8506, and Chloroflo 40, Plastichlor 40–60, Chlorowax 40, and Toyoparax 120.

38. A toner in accordance with claim 2 wherein the nonvolatile organic liquid is selected from the group consisting of the Chlorowaxes 40, 45LV, 50LV, and 100.

39. A toner composition comprised of a core comprised of polymer binder, nonvolatile organic liquid, and pigment; and wherein the core is encapsulated in a polymeric shell derived from interfacial polycondensation of a mixture of polyether isocyanates and polyisocyanate with polyamines.

40. A toner in accordance with claim 39 wherein the pigment is selected from the group consisting of red, blue, green, brown, cyan, magenta, yellow, or mixtures thereof.

41. A toner in accordance with claim 39 wherein the pigment is magnetite.

42. A toner composition comprised of a core of polymer binder, nonvolatile liquid hydrocarbon, and pigment; and wherein the core is encapsulated in a polymeric shell obtained by interfacial polycondensation of a mixture of polyether isocyanates and polyisocyanate monomers with polyamines.

43. A toner composition comprised of a core of polymers, nonvolatile liquid hydrocarbons, and pigment particles; and wherein the core is encapsulated in a polymeric shell obtained by interfacial polycondensation of a mixture of polyether isocyanates and polyisocyanate with polyamines.

44. A toner in accordance with claim 2 wherein the shell is prepared by interfacial polymerization.

45. A toner in accordance with claim 3 wherein the shell is prepared by interfacial polymerization.

46. A toner in accordance with claim 4 wherein the core is selected from the group consisting of the copolymeric derivatives of an acrylate polymer, a methacrylate polymer, and a styrene polymer.

47. A toner in accordance with claim 5 wherein the core is selected from the group consisting of the copolymeric derivatives of an acrylate polymer, a methacrylate polymer, and a styrene polymer.

* * * * *